US006640872B1

(12) United States Patent
Mullet

(10) Patent No.: US 6,640,872 B1
(45) Date of Patent: Nov. 4, 2003

(54) NON-BINDING SECTIONAL DOOR AND METHOD OF ASSEMBLY

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/132,824

(22) Filed: Apr. 24, 2002

(51) Int. Cl.[7] ..... E06B 3/48
(52) U.S. Cl. ..... 160/229.1; 160/201; 160/218
(58) Field of Search ..... 160/201, 209, 160/229.1, 218, 220, 231.1, 233, 235, 267, 323; 49/383

(56) References Cited

U.S. PATENT DOCUMENTS

| | | | | | |
|---|---|---|---|---|---|
| 3,813,730 | A | * | 6/1974 | Smith | 16/135 |
| 4,205,713 | A | * | 6/1980 | Galbreath | 160/201 |
| 4,903,434 | A | * | 2/1990 | Loos | 49/192 |
| 4,918,890 | A | | 4/1990 | Stafford | 52/291 |
| 5,129,441 | A | | 7/1992 | Leist et al. | 160/229.1 |
| 5,133,108 | A | * | 7/1992 | Esnault | 16/225 |
| 5,148,850 | A | * | 9/1992 | Urbanick | 160/231.1 |
| 5,235,724 | A | * | 8/1993 | Perrin et al. | 16/97 |
| 5,409,051 | A | * | 4/1995 | Mullet et al. | 160/201 |
| 5,509,457 | A | | 4/1996 | Jellá | 160/201 |
| 5,566,740 | A | | 10/1996 | Mullet et al. | 160/229.1 |
| 5,842,508 | A | | 12/1998 | Krupke et al. | 160/235 |
| 5,913,352 | A | * | 6/1999 | Scates et al. | 160/229.1 |
| 5,934,352 | A | * | 8/1999 | Morgan | 160/201 |
| 6,006,817 | A | | 12/1999 | Stone et al. | 160/201 |
| 6,041,478 | A | | 3/2000 | Martin | 16/385 |
| 6,076,590 | A | * | 6/2000 | Ford et al. | 160/229.1 |
| 6,098,697 | A | | 8/2000 | Krupke et al. | 160/229.1 |
| 6,527,036 | B1 | * | 3/2003 | Welsh | 160/201 |

* cited by examiner

*Primary Examiner*—Bruce A. Lev
(74) *Attorney, Agent, or Firm*—Renner, Kenner, Greive, Bobak, Taylor & Weber

(57) ABSTRACT

A sectional door movable between a closed vertical position and an open horizontal position having, a series of adjacent panels, each of the panels having an upper joint member and a lower joint member, the lower joint member having a configuration to establish a clearance with the configuration of the upper joint member of an adjacent panel during angular articulation of the adjacent panels in moving between the closed vertical position and the open horizontal position, end hinge assemblies located proximate the longitudinal ends of the panels and connecting the adjacent panels at a first pivot axis, and at least one center hinge assembly connecting the adjacent panels at a second pivot axis offset from the first pivot axis, whereby a portion of the clearance is maintained irrespective of variations in the deflection of the panels in moving between the closed vertical position and the open horizontal position.

26 Claims, 5 Drawing Sheets

NON-BINDING SECTIONAL DOOR AND METHOD OF ASSEMBLY

TECHNICAL FIELD

The present invention relates generally to sectional doors which move between a closed vertical position and an open horizontal position. More particularly, the present invention relates to a non-binding sectional door and a method of assembly which compensates for the bowing of sectional door panels during movement between the vertical and horizontal positions. More specifically, the present invention relates to a door and method for locating the hinges between panels of such sectional doors to whereby the adjacent panels do not contact and bind when moving on tracks between the closed vertical position and the open horizontal position.

BACKGROUND ART

It is known that sectional door panels of the type employed in garages or other buildings that move between a closed vertical position and an open horizontal position will necessarily deflect or sag when in the open horizontal position. This is because of the panel construction and the fact that the panels are supported in such position solely by rollers at each end of the panels. When two adjacent panels are both in the horizontal position in the horizontal track sections, there is potentially no problem, inasmuch as the sag at the adjacent panel edges is essentially identical. Similarly, there is essentially no problem when adjacent panels are in the vertical closed position, as there is essentially no sag in a direction perpendicular to the face of the panel. A problem arises, however, when adjacent panels are passing through the curved transition track section between the vertical section and the horizontal section. In that instance, the horizontally disposed panel is approaching its maximum deflection while the adjacent panel in the curved transition track section is undergoing a substantially lesser deflection which may produce rubbing contact or even binding at the mating edges of the panels. The extent of this deflection varies with the angular position relative to vertical of adjacent panels passing through the curved transition track section.

While it is impractical to totally eliminate deflection in such sectional door panels, the amount of deflection varies greatly depending upon the width of the door, the thickness of the surface material, the presence or absence of a backer, the presence or absence of foamed reinforcement, and the presence or absence and design of rails, struts or other reinforcing members proximate the panel edges. Normally, deflection or sagging is most critical in pan doors without any of the strengthening or reinforcing features alluded to above. Absent unusual reinforcing in a door panel, the maximum deflection is normal to the face of the door at substantially the center point intermediate the panel ends. Industry specifications indicate that the deflection or sagging can be up to $1/120$ of the door width and be considered acceptable. Thus, in the case of a standard 16 foot double car door, the deflection can be as much as approximately 41 mm and remain within industry standards.

For a number of years, it was common to employ door edge profiles with varying gaps in the panel to adjacent panel interfaces. This was accomplished with the use of flexible hinges or other constructions which permit varying the gaps between the panel at differing locations during their travel between the closed vertical position and the open horizontal position. In other instances, the panel-to-panel edges develop greater spacing therebetween when adjacent panels are at greater angularity, as when passing through the curved transition track section between the vertical track sections and the horizontal track sections. With this type of a varying gap panel spacing as a function of relative adjacent panel angularity, the deflection can be accommodated without binding or even rubbing or other contact between adjacent panel edges.

More recently, the design of the section interfaces have gone to pinch resistant configurations which will neither allow fingers to be inserted in the interface nor allow the interface to close down on fingers by maintaining a clearance or gap of less then 9 millimeters at all times during door movement. Even more desirably, maintaining the clearance or gap at less then 4 millimeters prevents pinching the skin such as to create a "blood blister". Since these pinch resistant configurations must maintain a minimal clearance or gap throughout its operating range such creates a serious problem in efforts to design an anti-pinch door without the inherent sag or deflection of the door panels producing rubbing or binding of the mating joints. This is because the deflection can greatly exceed the required and desired clearance for pinch resistant configurations.

In the instances of pinch resistant designs, binding can be encountered to an extent that an undesirable amount of force is required to move the panel interfaces through the curved transition track section for a door. Further, the force varies at different locations through the transitional track section and is not constant, such that it creates a surging condition in door operation. The surging can be recognized as erratic movement caused by rapid acceleration and deceleration of the door motion during its travel between the closed vertical position and the horizontal open position. Doors which employ openers or operators often use a control system that monitors force required to move the door as a function of door travel as a method to determine entrapment may be unable to respond to the surging of the door or the additional force required to overcome binding. This may result in false stops where a control system senses entrapment of a foreign object or other erratic operation of the control system and thus, the motorized operation of the door.

Thus, there remains a need for a non-binding door design which does not possess the reinforcing features and attendant costs normally associated with pinch resistant doors.

DISCLOSURE OF THE INVENTION

Accordingly, it is an object of the present invention to provide a sectional door wherein the panel interfaces maintain a minimal gap during movement between a closed vertical position and an open horizontal position satisfying pinch resistant specifications. Another object of the present invention is to provide such a sectional door which eliminates rubbing and possible binding between interfaces of adjacent panels even during moving through the curved transition track section between the vertical track section and the horizontal track section. An additional object of the invention is to provide such a sectional door that eliminates or at least minimizes surging such that successful use with conventional powered openers or operators and control systems therefor is assured. A further object of the present invention is to provide such a sectional door wherein the clearance or gap between the joints of adjacent sections be maintained with a gap or clearance of less than 1 millimeter without rubbing or binding during movements between the closed vertical position and open horizontal position of the door.

Another object of the present invention is to provide a sectional door which has essentially minimal constant gap panel interfaces which do not require special design profiles on the joints forming the interfaces between adjacent panels. Yet another object of the present invention is to provide such a sectional door which does not require the presence of rub strips or barriers at the interfaces between adjacent panels. Another object of the present invention is to provide such a sectional door which does not require any additional or modified components. A further object of the present invention is to provide such a door which is readily operable with counterbalance systems, operators or openers, and control systems that are conventionally designed for a door configuration.

It is yet another object of the present invention to provide such a sectional door which can exceed both mandatory and desired pinch resistant specifications recognized in the industry. A further object of the present invention is to provide such a sectional door having no additional manufacturing costs above those for a comparable door not incorporating the present invention. Yet a further object of the present invention is to provide such a sectional door which does not require any additional labor input to effect the manufacture, assembly, or installation of doors embodying the present invention as compared with an identical conventional door.

In general, the present invention contemplates a sectional door movable between a closed vertical position and an open horizontal position having, a series of adjacent panels, each of the panels having an upper joint member and a lower joint member, the lower joint member having a configuration to establish a clearance with the configuration of the upper joint member of an adjacent panel during angular articulation of the adjacent panels in moving between the closed vertical position and the open horizontal position, end hinge assemblies located proximate the longitudinal ends of the panels and connecting the adjacent panels at a first pivot axis, and at least one center hinge assembly connecting the adjacent panels at a second pivot axis offset from the first pivot axis, whereby a portion of the clearance is maintained irrespective of variations in the deflection of the panels in moving between the closed vertical position and the open horizontal position.

BEST MODE FOR CARRYING OUT THE INVENTION

Figure 1:
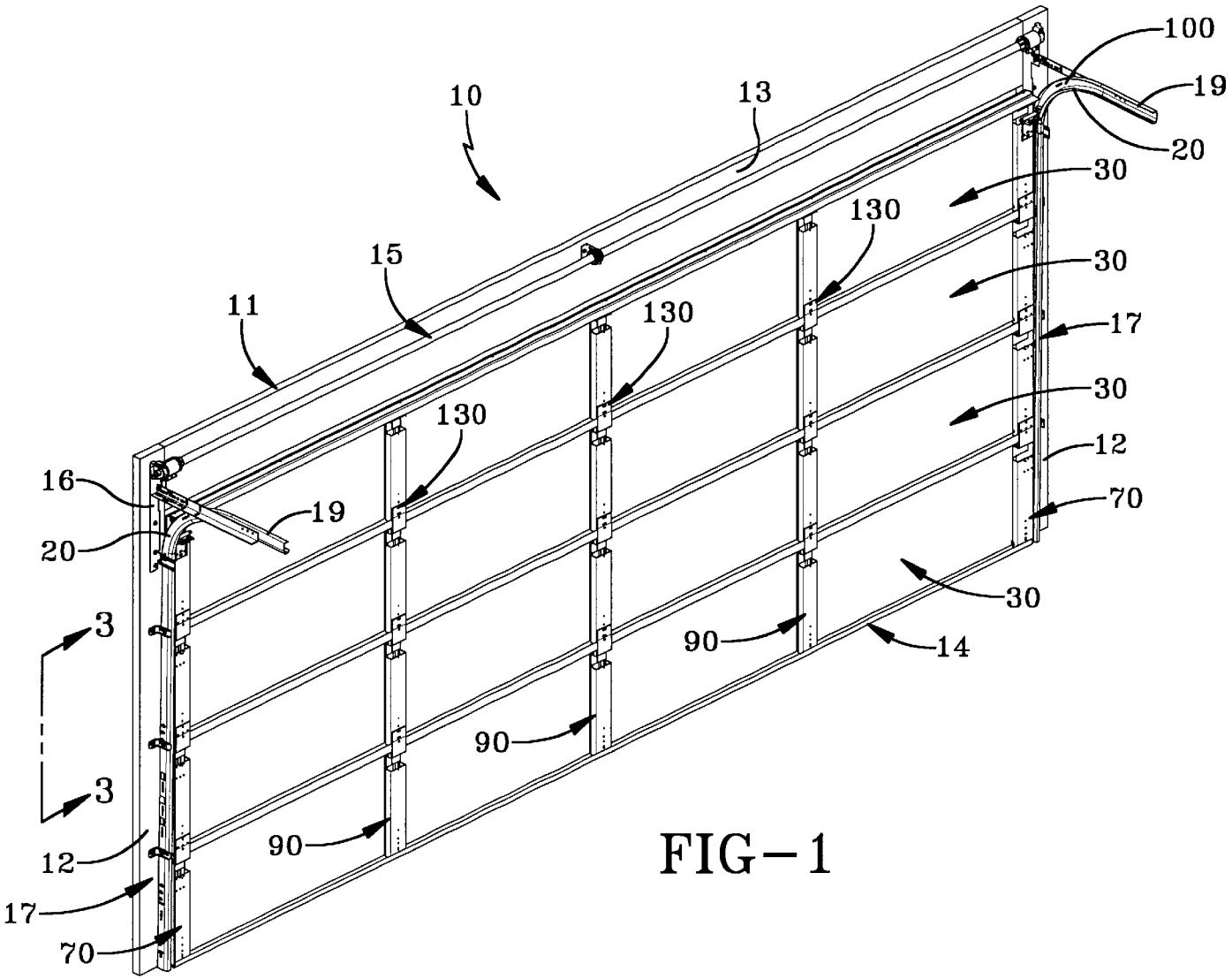
FIG. 1 is a fragmentary rear perspective view of an overhead sectional door system incorporating the concepts of the present invention and depicting a plurality of door panels making up the sectional door shown in conjunction with a track system for controlling movement of the door between a closed vertical position and an open horizontal position and a counterbalance system for the door.
Figure 2:
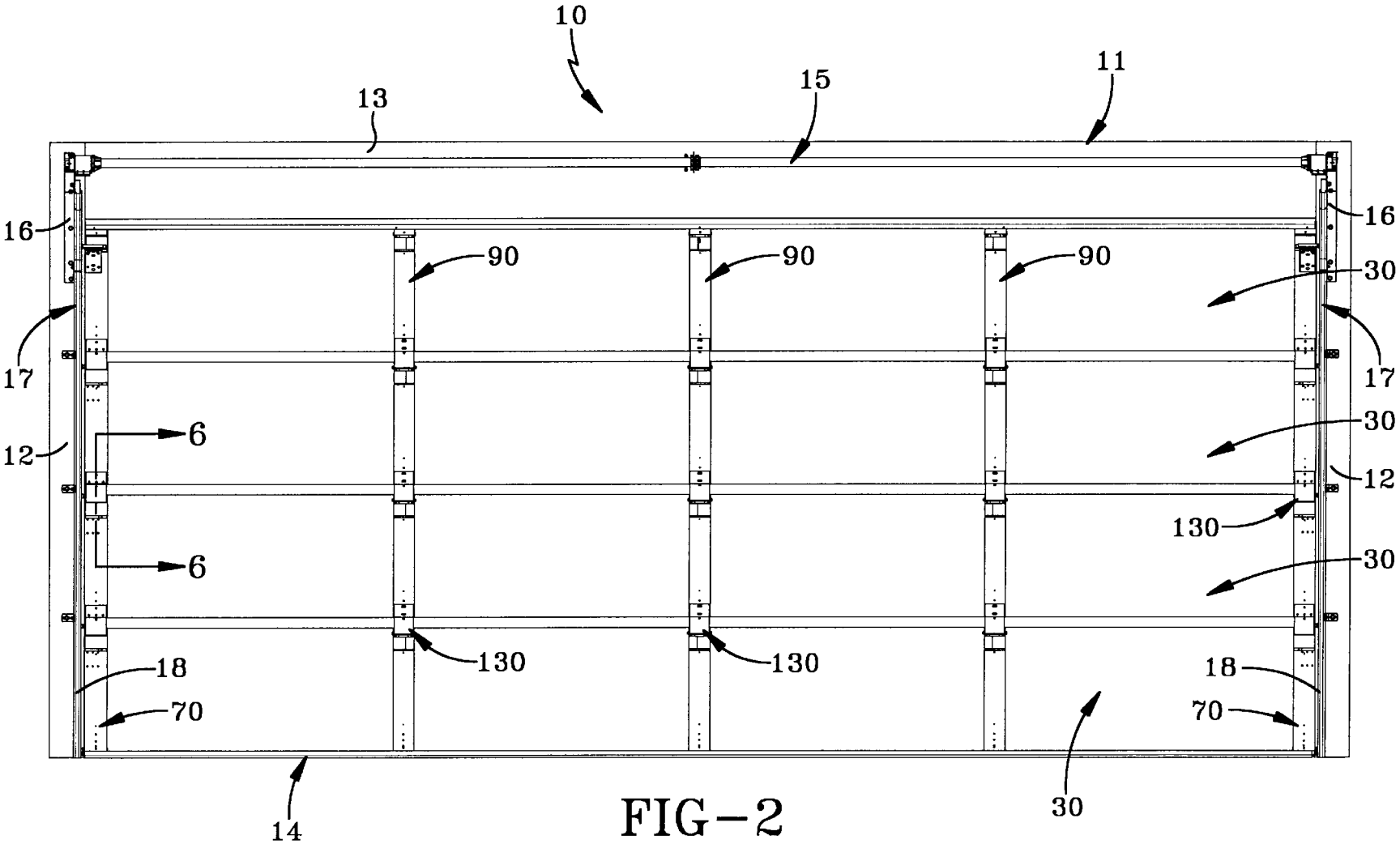
FIG. 2 is a rear plan view showing additional details of the door of FIG. 1.

An upward acting insulated or uninsulated sectional door system embodying the concepts of present invention is generally indicated by the numeral 10 in FIGS. 1 and 2 of the drawings. The door system 10 is positioned and mounted for opening and closing movement in a building, trailer or other structure by a peripheral door frame, generally indicated by the numeral 11. The frame 11 consists of a pair of spaced vertical jambs 12, that, as seen in FIGS. 1 and 2, are generally parallel and extend vertically upwardly relative to a supporting surface such as the ground, a floor, or the bed of a trailer (not shown). The vertical jambs 12, 12 are spaced and joined proximate their vertical upper extremity by a header 13 to thereby define the generally inverted U-shaped frame 11 for mounting a door, generally indicated by the numeral 14. The frame 11 may be constructed of wood, metal, or other relatively high-strength, rigid material for purposes of reinforcement, attachment to a building or vehicle, and facilitating the attachment of elements involved in supporting and controlling the door 14.

The header 13 may advantageously mount a counterbalance system, generally indicated by the numeral 15 that interacts with the door 14 to facilitate raising and lowering of the door 14 in a manner well known to persons skilled in the art. The counterbalance system 15 may be in accordance with the characteristics of a counterbalance system according to Applicant's Assignee's U.S. Pat. No. 5,419,010, which is shown for exemplary purposes and the disclosure therein incorporated herein by reference. It will be appreciated that any of a variety of counterbalancing systems may be employed.

As seen in FIGS. 1 and 2, flag angles 16 mounted on frame 11 are provided to partially support roller track assemblies, generally indicated by the numerals 17, 17, which are positioned to either side of the door 14. Each of the roller track assemblies 17, 17 include a vertical track section 18, a horizontal track section 19, and a transition track section 20 interposed therebetween. The roller track assemblies 17, 17 support and direct travel of the door 14 in moving from the closed vertical position, depicted in FIGS. 1 and 2, associated with vertical track sections 18, 18 of roller track assemblies 17, 17, through transition track sections 20, 20 to an open, horizontal position associated with horizontal track sections 19, 19. The ends of horizontal track sections 19, 19 displaced from the door 14 are joined and supported by back bars (not shown) attached directly or indirectly to the ceiling or walls of a structure in which the door system 10 is installed.

A four-panel sectional door 14 is shown for exemplary purposes in FIG. 1 of the drawings. However, it will be appreciated that additional panels may be employed in sectional doors of this type depending upon the height of the door opening, the width of the panels, and related considerations. As depicted, the door 14 has a plurality of panels or sections, generally indicated by the numeral 30. Each of the panels 30 has generally the same configuration, and thus for exemplary purposes, only a single panel 30 will be discussed in detail.

Figure 6:
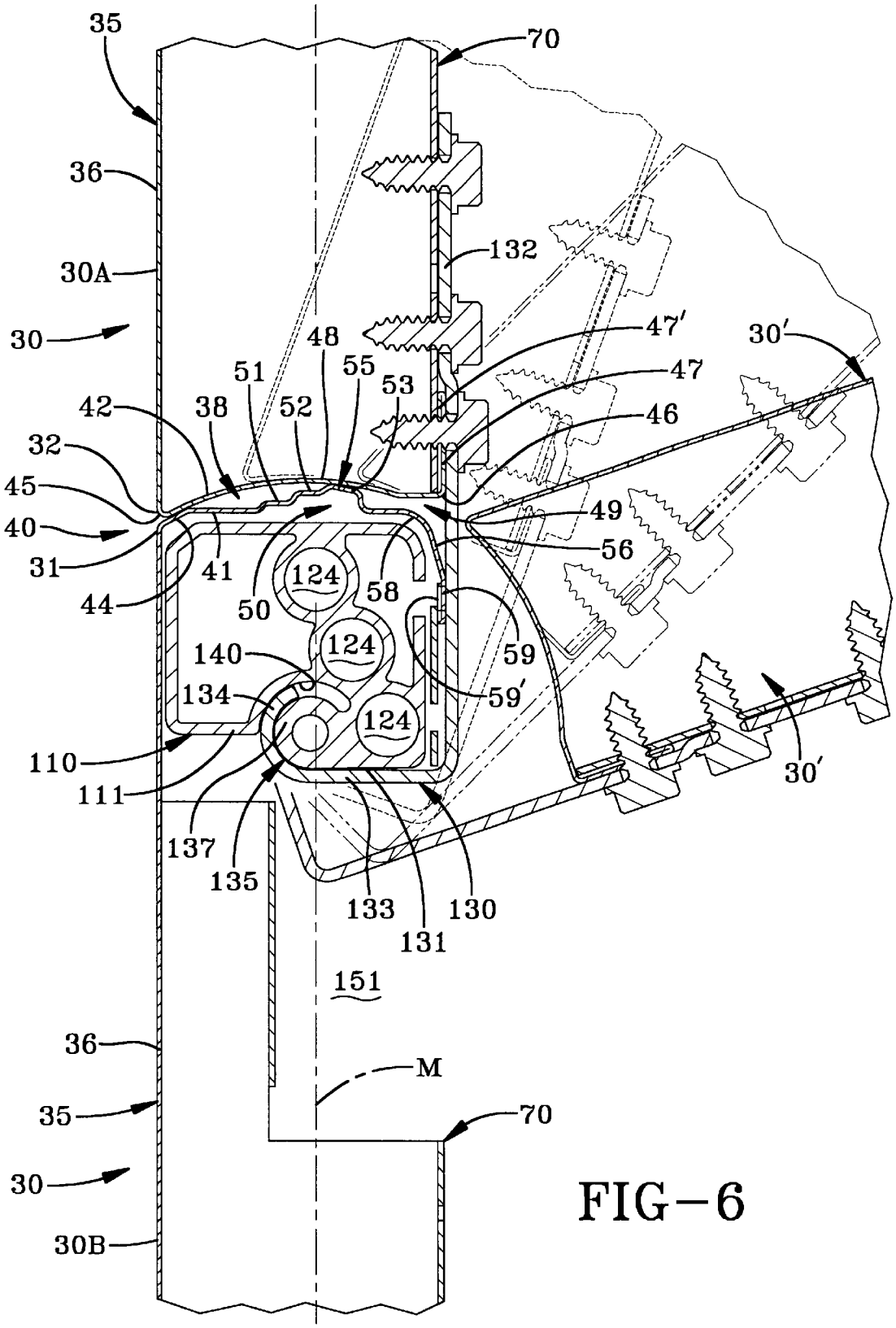
FIG. 6 is a fragmentary sectional view through an end stile taken substantially along the line 6—6 of FIG. 2 depicting details of the hinges.

As shown particularly in FIG. 6, door system 10 includes door 14 which for exemplary purposes is a type of "pan door". Door 14 is detailed in Applicant's Assignee's copending U.S. application Ser. No. 10/132864, filed contemporaneously on Apr. 24, 2002, entitled "Sectional Door System" which is incorporated by reference herein. Insofar as pertinent the present invention door 14 has as a primary structural member a facer, generally indicated by the numeral 35, having a front surface 36 which may be essentially planar and extend substantially the height and width of panel 30. Joint assemblies, generally indicated by the numeral 40, extend rearward of front surface 36 at the top 31 and bottom 32 of panel 30. Joint assemblies 40 may include a first joint member 41 and a second joint member 42 shown, as an example, at the top and bottom 31 and 32, respectively, of the facer 35. Stacking of panels 30 in the vertical, closed configuration of door 14, depicted in FIG. 1, causes respective first and second joint members 41, 42 on adjacent panels 30 to mate to form an interface, generally indicated by the numeral 38 in FIG. 6 between adjacent panels. At the juncture of facer 35 and first joint member 41, facer 35 transcends into an upwardly sloping shoulder portion 44 defining an offset that provides a seat for a projecting nose 45 formed between the front surface 36 and the second joint member 42 on a superjacent panel 30A. In this respect, when adjacent panels 30A, 30B are in a planar orientation, as when the door 14 is in a closed position (FIG. 1), the nose 45 laps over the shoulder 44, in sealing relation of adjacent panels 30 at interface 38. This cooperative engagement of the nose 45 and shoulder 44 also aids in reinforcing panels 30 in their resistance to wind loads.

The second joint member 42 of panel 30A transcends a generally semicircular arc 48 extending from the nose 45 to a heel 46 formed between the second joint member 42 and tab 47 extending inwardly relative to the joint member 42 in a direction generally parallel to facer 35 and constituting the lower rear surface of panel 30. The tab 47 may have a return hem 47' to impart additional strength and rigidity to the panels 30. Heel portion 46 may be planar, as shown in FIG. 6, or transcend a downwardly projecting arc similar to nose 45. In either case, heel portion 46 provides a clearance at 49 for the first joint member 41 throughout its range of motion.

First joint member 41 may include a raised portion, generally indicated by the numeral 50, received within the umbrella of second joint member 42 and generally intermediate of the nose 45 and heel 46 thereof. The raised portion 50 may extend the entire length of panel 30, or as will be appreciated, may be provided at one or more portions of the top surface of the panel 30. Raised portion 50 extends upwardly to an extent necessary to contact second joint member 42, when the panels 30 are oriented in a planar vertical position associated with the closed door condition, as shown in FIG. 1.

Raised portion 50 may be integrally formed in first joint member 41, as by the first joint member 41 transcending an upwardly extending profile, which may be gradual or include a stepped increase in the height of the first joint member 41 defining a raised portion 50 having one or more tiers. In the embodiment shown in FIG. 6, a multi-tiered structure may include a first tier 51; a second tier 52 extending upwardly from the first tier 51; and a third tier 53, which is, in this example, the uppermost tier, extending upward from the second tier 52. Third tier 53 may have a generally planar top surface 54 which may contact the second joint member 42 in substantially a medial position relative to the front facer 36 and rear tab 47. The area of contact, generally indicated by the numeral 55, between the first joint member 41 and second joint member 42 at raised portion 50 may be located at any intermediate point on first joint surface 41, such as, a point just rearward of the midline M, as shown in FIG. 6.

To facilitate contact between the raised portion 50 and second joint member 42 when the door panels 30 are in the closed position, the top surface 54 of raised portion 50 may be given a slope so that planar top surface 54 is substantially tangential to arc 48 of second joint member 42 at the contact area. From uppermost tier 53, first joint member 41 descends at 58 to substantially its initial level. As at the front surface 35 of panel 30, first joint member 41 provides a clearance for free relative rotation between adjacent panels 30. For example, first joint member 41 may extend downward and rearward in a linear fashion forming a sloped offset surface 56 that bridges first joint member 41 and tab 59 extending generally parallel to facer 35 and constituting the upper rear of panel 30. The tab 59 may have a return hem 59' to impart additional strength and rigidity to the panels 30.

If desired, to reduce temperature transfer through the door 14 and/or to reduce noise transmission, insulating material (not shown) maybe carried or formed on or within panels 30. The insulating material may be a foam body which may be of any of a variety of polyurethane or polystyrene foaming materials commonly employed in the insulation of garage doors and the like.

Figure 3:
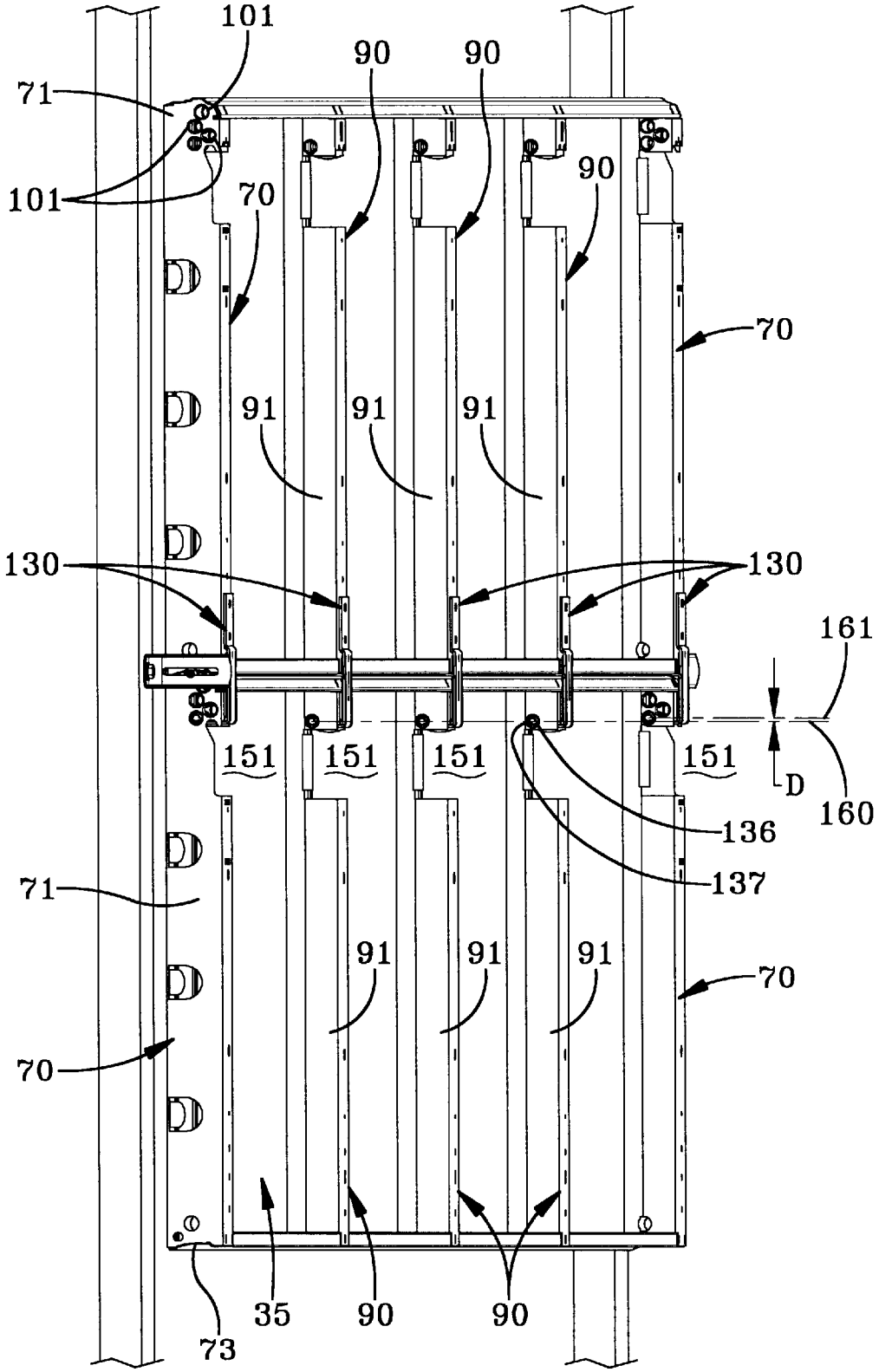
FIG. 3 is a fragmentary side elevational view seen from a vantage rotated through an angle of approximately 5° about the right hand side of the door depicted in FIG. 2 to show the relative placement of the hinges on the end stiles and center stiles.

To help support the door 14 and improve its rigidity, various vertical support members, such as stiles may be used in connection with the door panel 30. For example, end stiles, generally indicated by the numeral 70, maybe located at the lateral extremities of panels 30. If necessary or desirable, one or more center stiles, generally indicated by the numeral 90, may be located intermediate of the lateral extremities of panels 30. The end stiles 70, are generally elongate members that extend between the top 31 and bottom 32 of the panels 30. Stiles 70, 90 are adapted to fit within the confines of panels 30 and may be retained within facer 35. End stile 70 generally includes a stile body 71, which may be hollow and have a box-like section as shown in FIG. 3. Stile body 71 may be contoured at its top 72 and bottom 73 to substantially conform to the joint surfaces 41, 42 of the panels 30 and provide additional support thereto.

The center stiles 90, which may be similar to end stiles 70, are provided at one or more locations intermediate the end stiles 70. Since center stile 90 is similar to end stile 70, like numbers will be used to describe like portions of center stile 90. A single center stile 90 may be used, and it may be located at any point intermediate of end stiles 70, including a point near the center of the door's width. Similarly, multiple center stiles 90 may be placed at any position along the width of a panel 30. When multiple center stiles 90 are used, as shown for example in FIG. 1, center stiles 90 may advantageously be substantially evenly spaced from each other and for end stiles 70. However, variations in stile placement may be made to accommodate windows or other door design features. Center stile 90, like end stile 70, may have a box-like stile body 91 extending vertically between the top and bottom 31, 32 of panels 30 (FIG. 3). Like end stile 70, center stile 90 may be provided with a profile similar to the first and second joint surfaces 41, 42.

Rollers, generally indicated by the numeral 100 in FIG. 1, for supporting and guiding the door 14 are positioned outwardly of the end stiles 70. The end stiles 70 may support rollers 100, and, thus, be provided with openings 101 for receipt of roller shafts 102 (FIG. 3). The openings 101 may be formed near the vertical extremities of end stiles 70 of each panel 30 near the interface 38 of adjacent panels 30. As shown, multiple openings 101, or a single opening that accommodates multiple roller positions, such as a slot, may be formed in end stiles 70 such that the roller may be moved on end stile 70 to accommodate the angularity of vertical track sections 18, 18 relative to vertical jambs 12, 12 commonly employed in the art.

Referring to FIG. 6, a roller carrier, generally indicated by the numeral 110, may be fitted within end stile 70 to secure the roller 100 thereon. Referring to FIGS. 1A, 2 and 2A, the roller carrier 110 may include a hollow, block-like member or roller block 111 having an exterior surface that conforms to the interior of end stile 70 and may be inserted within the stile body 71 as indicated in FIG. 6. Roller block 111 defines one or more openings 124 in which a roller 100 may be received.

Hinge assemblies, generally indicated by the numeral 130 in FIGS. 3 and 6, pivotally connect panels 30, and may include various commercially available hinge that acts to help support and pivot the panels 30 as they travel from the vertical, closed position to the horizontal, open position. Each hinge assembly 130 may include a single leaf hinge 131. The single leaf hinge 131 is a unitary member, which may have any shape capable of coupling adjacent panels, and a pivot point located to allow proper articulation of the panels 30. Single leaf hinge 131 may, as shown, take the form of a generally L-shaped member having a first leg 132 extending adjacent the rear tabs 59 and 47 of the panel 30B and 30A, respectively, of FIG. 6 and shorter second leg 133 extending inward toward the front face 36 of the panel 30. The shorter leg 133 may have an end 134 that interacts with the door 14 in a pivoting fashion, as described more completely below.

Referring to FIG. 6, second leg 133 of hinge leaf 131 may extend toward the front surface 36 of facer 35 and attach to the door 14 beneath the interface 38 of adjacent panels 30A and 30B. The end 134 of second leg 133 may be pivotally attached to panel 14 or an end receiver assembly, generally indicated by the numeral 135 in FIG. 6. As shown in FIG. 6, end-receiving assembly 135 has an arcuate slot 140 to receive end 134 of hinge leaf 131. The slot 140 has a length sufficient for pivoting of the hinge 130 through the range of motion necessary for proper movement of the door panels 30 between the open and closed positions. For example, as shown in FIG. 6A, the operating range of a panel may include travel from the vertical aligned position to a maximum angled position 30'. In the center stiles 90 end 134 of hinge leaf 131 may pivot about a pivot pin 136 of the hinge mounted in an aperture 137 in body 91 (FIG. 3).

With second leg 133 pivotally attached, as by sliding end 134 laterally into slot 134, first leg 132 is attached to the adjacent panel 130 to couple adjacent panels 30 to each other. As shown in FIG. 6, for example, first leg 132 of hinge leaf 131 extends upwardly a sufficient extent to allow attachment of the first leaf 132 to a superjacent panel 30A. First leg 132 may be conventionally attached to stiles 70, 90 with fasteners 150 or suitable adhesives.

As best shown in FIG. 3, a clearance area 151 may be provided below second leg 133 to facilitate rotation of the hinge leaf 131, during operation of the door 14. As best shown in FIGS. 3, for example, rotation of the hinge leaf 131 causes second leg 133 to rotate in a clockwise fashion toward the stile 70, 90. Clearance area 151 is provided below hinge leaf 131 such that second leg 133 may rotate as the door 14 moves from a generally vertical, closed position to a generally horizontal, open position. It is to be appreciated that the configuration of the joint assemblies 41, 42 and the location of the pivot axis of hinge assemblies 130 combine to define the spacing between panels 30A and 30B and particularly nose 45 and second joint member 42 during the entire operating range of the angular articulation between adjacent panels.

Figure 4:
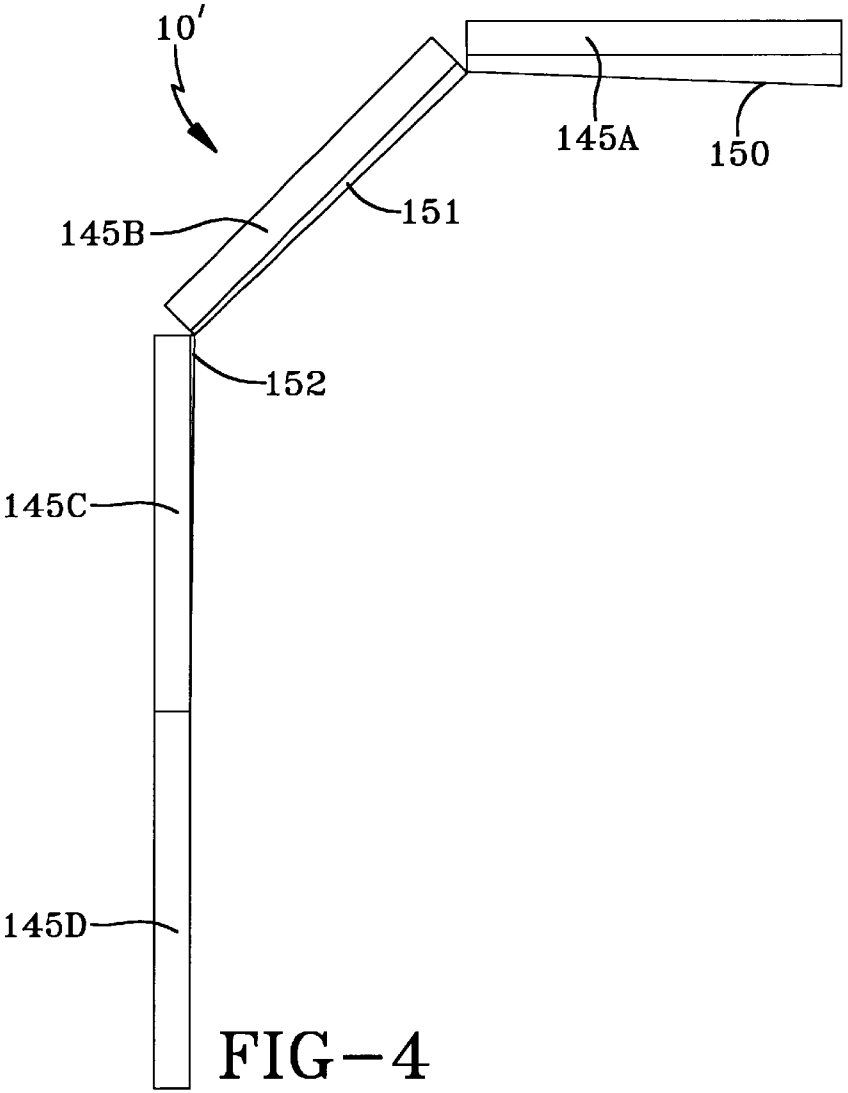
FIG. 4 is a schematic side elevational view with demonstrative depictions of a maximum deflection situation with the hinges conventionally mounted in alignment.

The present invention is directed toward compensating for deflection or sag existing when a door panel 30 is horizontally positioned, or nearly so, in roller track assemblies 17, 17. FIG. 4 demonstrates a conventional door construction and assembly of the type described above. The door is schematically indicated by the numeral 10' with an upper panel 145A, upper intermediate panel 145B, lower intermediate panel 145C and bottom panel 145B. As shown, the center surface 150 of panel 145A has the right hand side depicted in FIG. 4 at essentially a maximum deflection. The left hand edge of panel 145A is tending to effect a maximum deflection but is restrained by the hinge assemblies connecting panel 145A with panel 145B. Panel 145B in residing in an angular position undergoes a lesser defection with the center surface 151 deflected as shown in FIG. 4. The upper center surface 152 of panel 145C, which is in a nearly vertical position, is deflected primarily only due to the influence of panel 145B. With appreciable deflections at the center surface 150 and 154 at the juncture of panels 145A and 145B, there is commonly contact or binding between panels 145A and 145B. This produces a tendency for hinge assemblies 130 at the panel edges to pull out or loosen or for panel damage medially thereof by fatigue failure. This is because each time the door is raised or lowered, the junctures between panels 145A and 145B, 145B and 145C, and 145C and 145D, move through essentially the curved transition track sections 20, 20 which produce the deflection conditions depicted in FIG. 4.

The present invention contemplates offsetting the pivot axis 160, which is the center of pivot pins 136 of center stiles 90, the distance D below the pivot axis 161 of hinge assemblies 130 of the end stiles 70 of the door 10 as seen in FIG. 3 of the drawings. The distance of the offset is a variable which is a function of the length of the door panels, the weight of the panels, the rigidity of the panels, and other variables. In a test door constructed according to the invention, a center of a door panel for a 16-foot door deflected approximately 25 mm. It was empirically determined that with an offset distance D of 3 mm contact and binding between the panels 30 during articulation of the door was totally eliminated. The offset distance D may vary from approximately 1 mm to approximately 10 mm, depending upon the weight of a garage door, the length or span of the door panels and other factors. In this respect, shorter span, lighter weight doors normally require a lesser offset distance D, while longer, heavier panels 30 would require a greater offset distance D. Significantly, providing substantially the requisite offset distance D eliminates or at least minimizes surging such that successful operation with conventional powered openers or operators and control systems therefor is assured.

Figure 5:
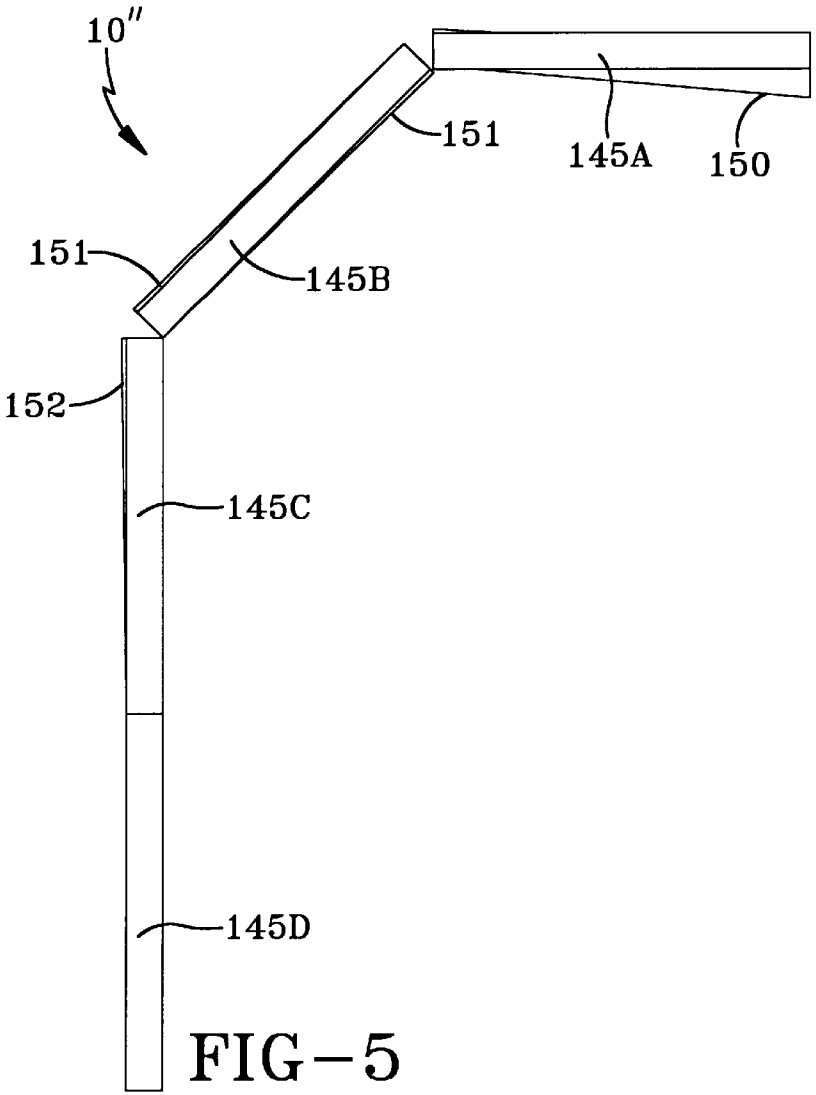
FIG. 5 is a schematic side elevational view with demonstrative depictions of a maximum deflection situation with the end hinges conventionally mounted in alignment and with the center hinges staggered or offset mounted according to the present invention.

As can be seen in FIG. 5, offsetting the pivot axis 160 of the hinge pins 136 of center stiles 90 below the pivot axis 161 of hinge assemblies 130 of the end stiles 70 of door 10" produces an entirely different deflection profile in the same position of the door 10' depicted in FIG. 4. As seen in FIG. 5, bottom center surface 150 of panel 145A has a maximum deflection at the right side of the panel, whereas the left side center deflection is essentially negligible or even slightly raised due to the offset of the pivot axis 160 of the hinges of the center stiles 90 relative to the pivot axis 161 of the end stile 70. At the same time, only minimal deflections of center surfaces 151 and 152 take place in the panels 145B and 145C of FIG. 5.

While approximations of an appropriate offset distance D for a given door can be made based upon the above considerations, it may be necessary to empirically determine the exact offset distance D for each individual door. In the example discussed above, a clearance or gap between panels during articulation of less than 1 mm may be achieved without rubbing or binding between adjacent panels 30. This is substantially less than the pinch resistant configuration standards of less than 9 mm to prevent finger insertion or clamping and even the less than 4 mm necessary to prevent pinching of the skin to create a "blood blister". While it is preferred that each of the center stiles 90 of a door 14 be provided with a hinge pin interconnecting adjacent panels 30, there may be instances where only the middle center stile or the two center stiles most closely proximate the center of a panel 30 be provided with hinges.

Thus, it should be evident that the non-binding sectional door and method of assembly disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

What is claimed is:

1. A sectional door movable between a closed vertical position and an open horizontal position comprising, a series of adjacent panels, each of said panels having an upper joint member and a lower joint member, said lower joint member having a configuration to establish a clearance with the configuration of the upper joint member of an adjacent panel during angular articulation of said adjacent panels in moving between the closed vertical position and the open horizontal position, end hinge assemblies located proximate the longitudinal ends of said panels and connecting said adjacent panels at a first pivot axis, and at least one center hinge assembly connecting said adjacent panels at a second pivot axis offset from said first pivot axis, whereby a portion of said clearance is maintained irrespective of variations in the deflection of said panels in moving between the closed vertical position and the open horizontal position.

2. A sectional door of claim 1, wherein said center hinge assembly is located substantially medially between said end hinge assemblies.

3. A sectional door according to claim 1, wherein said second pivot axis is offset vertically below said first pivot axis when the door is in the closed vertical position.

4. A sectional door of claim 3, wherein said offset is a distance of from approximately 1 mm to 10 mm.

5. A sectional door according to claim 3, wherein said offset is a distance of approximately 3 mm.

6. A sectional door according to claim 1, wherein said panels have end stiles proximate said longitudinal ends of said panels on which said end hinge assemblies are attached.

7. A sectional door according to claim 6, wherein said panels have at least one center stile and said center hinge is located on said center stile.

8. A sectional door according to claim 6, wherein said panels have an odd number of center stiles positioned between said end stiles with said center hinge assembly being located on the medial one of said center stiles.

9. A sectional door according to claim 6, wherein said panels have an odd number of center stiles with one of said center hinge assemblies located on each of said center stiles.

10. A sectional door according to claim 6, wherein said panels have an even number of center stiles positioned between said end stiles with one of said center hinge assemblies mounted on the two center stiles in closest proximity to a midpoint between said end stiles.

11. A sectional door according to claim 6, wherein said panels have an even number of center stiles positioned between said end stiles with one of said center hinge assemblies located on each of said center stiles.

12. A sectional door according to claim 1, wherein said end hinge assemblies and said center hinge assembly are single leaf hinges.

13. A sectional door according to claim 1, wherein said clearance between said joint members during angular articulation does not exceed 9 mm.

14. A sectional door according to claim 1, wherein said clearance between said joint members during angular articulation does not exceed 4 mm.

15. A sectional door according to claim 1, wherein said clearance between said joint members during angular articulation does not exceed 1 mm.

16. A sectional door according to claim 1, wherein said upper joint member and said lower joint member define a pinch resistant configuration.

17. A method for compensating for deflection of sectional door panels suspended by rollers movable in tracks between a closed vertical position and an open horizontal position comprising the steps of:

locating a plurality of the panels in adjacent longitudinal edge to longitudinal edge relationship;

attaching end hinge assemblies proximate the ends of the panels with the pivot axis thereof located such as to maintain the distance between the longitudinal edges of the ends of adjacent panels at less than a specified maximum clearance without contact during articulation attendant moving the door between the closed vertical position and the open horizontal position; and attaching at least one center hinge assembly intermediate the ends of the panels with the pivot axis thereof offset from said pivot axis of said end hinge assemblies, whereby a distance less than said specified maximum clearance is maintained between edges of adjacent panels without contact over the entire length irrespective of variations in the deflection tendencies of said panels in moving between the closed vertical position and the open horizontal position.

18. The method of claim 17 including, providing an offset of approximately 1 mm to approximately 10 mm.

19. The method of claim 17 including, providing an offset of approximately 1 mm to approximately 3 mm.

20. The method of claim 17 further comprising the steps of, mounting end stiles on said panels; and attaching said end hinge assemblies to said end stiles.

21. The method of claim 20 further comprising the steps of, mounting center stiles on said panels; and attaching said center hinge assemblies to said center stiles.

22. The method of claim 21 including the step of, employing single leaf hinges as said end hinge assemblies and said center hinge assemblies.

23. The method of claim 21 including the steps of, boring apertures in said center stiles; and inserting pivot pins in said apertures for constituting the pivot axis of said center hinge assemblies.

24. The method of claim 23 including the step of, colinearly locating the pivot axis of all of said center hinge assemblies.

25. A sectional door movable between a closed vertical position and an open horizontal position comprising, a series of adjacent panels, each of said panels having an upper joint member and a lower joint member, said lower joint member having a configuration to establish a clearance with the configuration of the upper joint member of an adjacent panel during angular articulation of said adjacent panels in moving between the closed vertical position and the open horizontal position, end hinge means located proximate the longitudinal ends of said panels and connecting said adjacent panels at a first pivot axis, and center hinge means connecting said adjacent panels at a second pivot axis offset from said first pivot axis, whereby a portion of said clearance is maintained irrespective of variations in the deflection of said panels in moving between the closed vertical position and the open horizontal position.

26. A sectional door of claim 25, wherein said end hinge means and said center hinge means are single leaf hinges.

* * * * *

US006640872C1

(12) INTER PARTES REEXAMINATION CERTIFICATE (0439th)

United States Patent

Mullet

(10) Number: US 6,640,872 C1

(45) Certificate Issued: Aug. 28, 2012

(54) NON-BINDING SECTIONAL DOOR AND METHOD OF ASSEMBLY

(75) Inventor: Willis J. Mullet, Gulf Breeze, FL (US)

(73) Assignee: Overhead Door Corporation, Lewisville, TX (US)

Reexamination Request:
No. 95/000,304, Oct. 5, 2007

Reexamination Certificate for:

| | |
|---|---|
| Patent No.: | **6,640,872** |
| Issued: | **Nov. 4, 2003** |
| Appl. No.: | **10/132,824** |
| Filed: | **Apr. 24, 2002** |

(51) Int. Cl.

| | |
|---|---|
| ***E06B 3/48*** | (2006.01) |
| ***E06B 3/32*** | (2006.01) |
| ***E05D 15/16*** | (2006.01) |
| ***E05D 15/24*** | (2006.01) |

(52) U.S. Cl. ..... 160/229.1; 160/201; 160/218

(58) Field of Classification Search ..... None
See application file for complete search history.

(56) References Cited

To view the complete listing of prior art documents cited during the proceeding for Reexamination Control Number 95/000,304, please refer to the USPTO's public Patent Application Information Retrieval (PAIR) system under the Display References tab.

*Primary Examiner*—Jeffrey L. Gellner

(57) ABSTRACT

A sectional door movable between a closed vertical position and an open horizontal position having, a series of adjacent panels, each of the panels having an upper joint member and a lower joint member, the lower joint member having a configuration to establish a clearance with the configuration of the upper joint member of an adjacent panel during angular articulation of the adjacent panels in moving between the closed vertical position and the open horizontal position, end hinge assemblies located proximate the longitudinal ends of the panels and connecting the adjacent panels at a first pivot axis, and at least one center hinge assembly connecting the adjacent panels at a second pivot axis offset from the first pivot axis, whereby a portion of the clearance is maintained irrespective of variations in the deflection of the panels in moving between the closed vertical position and the open horizontal position.

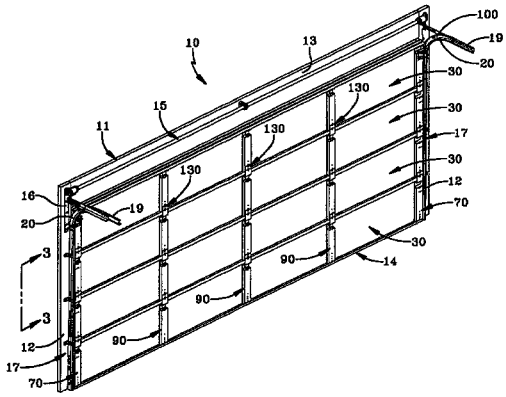

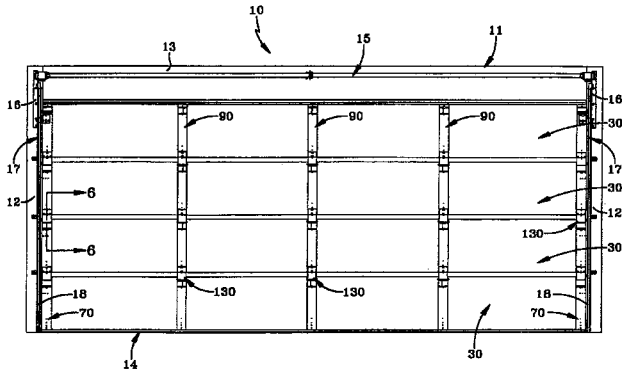

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1-22, 25 and 26 is confirmed. Claims 23 and 24 were not reexamined.

* * * * *